US005493806A

United States Patent [19]

Langevin et al.

[11] Patent Number: 5,493,806

[45] Date of Patent: Feb. 27, 1996

[54] STRIKER RETAINING SYSTEM FOR A FIREARM

[75] Inventors: Kevin R. Langevin, Indian Orchard, Mass.; Scott A. Ladd, Coventry, Conn.

[73] Assignee: Colt's Manufacturing Company Inc., West Hartford, Conn.

[21] Appl. No.: 310,163

[22] Filed: Sep. 21, 1994

[51] Int. Cl.[6] ..... F41A 19/36

[52] U.S. Cl. ..... 42/69.02; 42/70.08

[58] Field of Search ..... 42/69.01, 69.02, 42/70.01, 70.08; 89/132, 154

[56] References Cited

U.S. PATENT DOCUMENTS

| | | | |
|---|---|---|---|
| 1,047,671 | 12/1912 | Mauser | 42/69.02 |
| 5,036,612 | 8/1991 | Jennings | 42/70.08 |
| 5,050,480 | 9/1991 | Knight, Jr. et al. | 89/147 |
| 5,081,780 | 1/1992 | Lishness et al. | 42/69.01 |
| 5,105,570 | 4/1992 | Lishness et al. | 42/69.01 |
| 5,157,209 | 10/1992 | Dunn | 42/70.08 |
| 5,247,757 | 9/1993 | Deeb | 42/70.08 |
| 5,259,138 | 11/1993 | Scirica | 42/70.08 |

*Primary Examiner*—Stephen C. Bentley
*Attorney, Agent, or Firm*—Perman & Green

[57] ABSTRACT

A firearm with a frame, a slide, a striker, and a striker retaining system. The striker is connected to the frame inside the slide. The striker has a firing pin biased by a spring in a forward direction. The retaining system has a retainer pin and a spring. The retaining pin is mounted to the frame and is adapted to automatically engage the striker when the slide is removed from the frame. This prevents the striker from being inadvertently released as a projectile off of the frame when the slide is not mounted to the frame.

7 Claims, 1 Drawing Sheet

STRIKER RETAINING SYSTEM FOR A FIREARM

BACKGROUND OF THE INVENTION

1. Field of the Invention

The present invention relates to firearms and, more particularly, to a system for restraining a striker of a firearm.

2. Prior Art

U.S. Pat. No. 5,050,480 discloses a pistol with a striker having a coiled spring and a longitudinally moved case with a firing pin. U.S. Pat. Nos. 5,157,209 and 5,259,138 disclose blockers in front of longitudinally moved firing pins. U.S. Pat. No. 5,247,757 shows a firing pin mounted to a frame separate from a slide.

SUMMARY OF THE INVENTION

In accordance with one embodiment of the present invention, a firearm having a frame, a slide, a striker, and a safety system is provided. The safety system comprises a retainer member, a spring, and a surface on the slide. The retainer member is movably mounted to the frame for retaining the striker at a predetermined position on the frame when the slide is removed from the frame. The spring biases the retainer member towards a striker retaining position. The surface on the slide is for maintaining the retainer member at a non-retaining position while the slide is operationally connected to the frame. The retainer member limits movement of the striker on the frame only when the slide is removed from the frame.

In accordance with another embodiment of the present invention, a firearm is provided having a frame, a slide, a striker, and a retainer. The striker is connected to the frame inside the slide. The striker has a firing pin biased by a striker spring in a forward direction. The retainer is movably mounted to the frame. The retainer is adapted to automatically engage the striker when the slide is removed from the frame to prevent the striker from being released as a projectile by the striker spring off of the frame when the slide is not mounted to the frame.

BRIEF DESCRIPTION OF THE DRAWINGS

The forgoing aspects and other features of the present invention are explained in the following description, taken in connection with the accompanying drawings, wherein.

DETAILED DESCRIPTION OF THE PREFERRED EMBODIMENT

Figure 1:
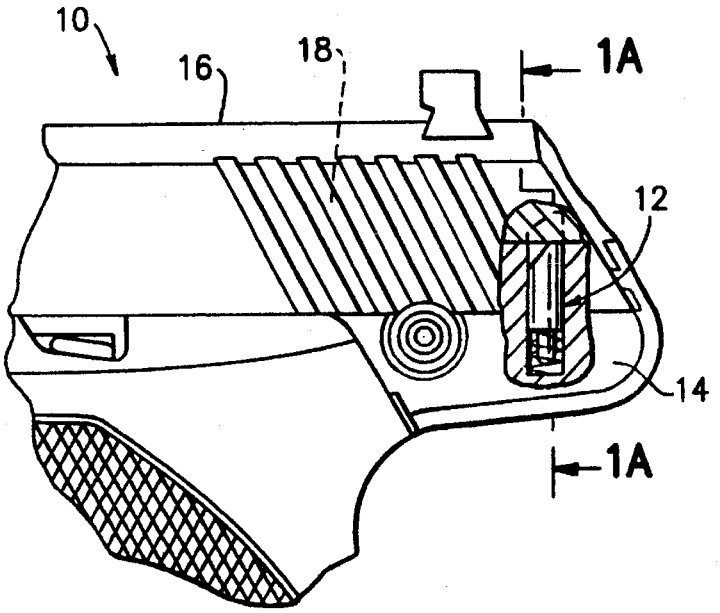
FIG. 1 is an elevational side view of a rear end of a firearm with a cutaway section having a striker retaining system incorporating features of the present invention.

Referring to FIG. 1, there is shown an elevational side view of a rear portion of a pistol 10 having a striker retaining system 12 incorporating features of the present invention. Although the present invention will be described with reference to the single embodiment shown in the drawings, it should be understood that the present invention may be incorporated into various different types of alternate embodiments and various different types of firearms. In addition, any suitable size, shape or type of members, elements or materials could be used.

Figure 1A:
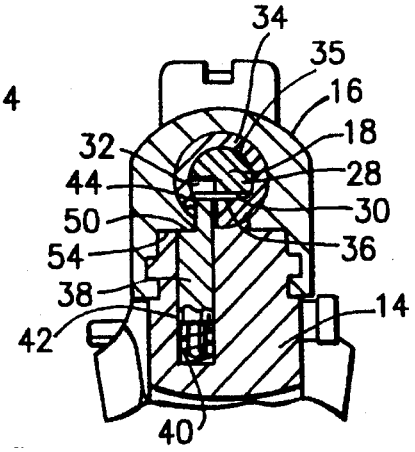
FIG. 1A is a cross-sectional view of the firearm shown in FIG. 1 taken along line 1A—1A.
Figure 2:
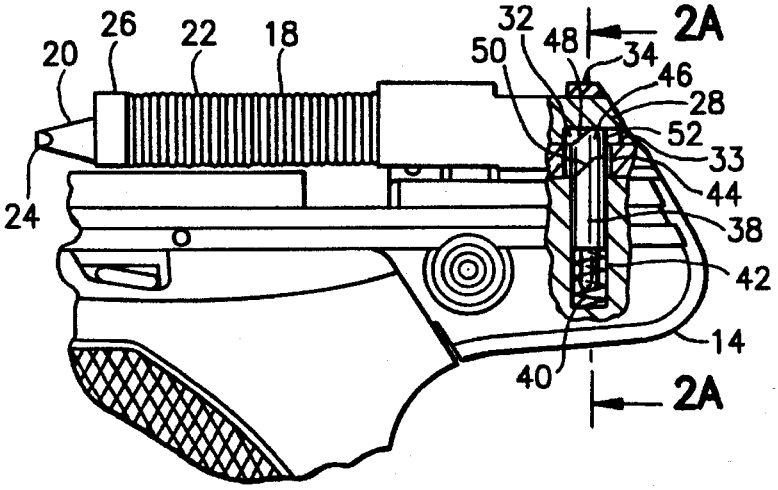
FIG. 2 is an elevational side view of the firearm as shown in FIG. 1 with the slide removed from the frame.
Figure 2A:
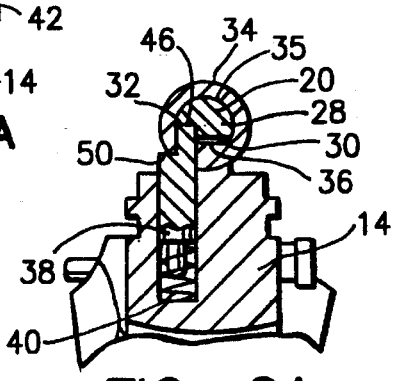
FIG. 2A is a cross-sectional view of the firearm shown in FIG. 2 taken along line 2A—2A.

The pistol 10 generally comprises a frame 14, a slide 16, a barrel (not shown), and a firing mechanism which includes a striker 18. Referring also to FIG. 1A and FIGS. 2 and 2A, that show the pistol 10 with the slide 16 removed from the frame 14, the striker 18 generally comprises a firing pin 20 and a coil spring 22. FIG. 2 shows the striker 18 at a cocked position. U.S. Pat. No. 5,050,480 describes a similar striker, which is hereby incorporated by reference in its entirety. U.S. Pat. Nos. 5,081,780 and 5,105,570 are also incorporated by reference in their entirety for understanding of general striker functioning. The firing pin 20 has a tip 24 for contacting a cartridge, a front ledge 26 behind the tip 24, and a rear end 28. The rear end 28 of the firing pin 20 has a flat bottom keyed surface 30 and a notch 32. The rear end 33 of the notch 32 forms a latching surface. The rear end 28 of the firing pin is longitudinally slidingly located in a channel 35 of a striker sleeve 34. The sleeve 34 is stationarily attached to the frame 14. Thus, the sleeve 34 might be considered part of the frame 14. The channel 35 of the striker sleeve 34 also has a flat keyed surface 36 that cooperates with surface 30 to prevent axial rotation of the firing pin 20 relative to the frame 14. The striker spring 22 can be compressed between the striker sleeve 34 and the front ledge 26 of the firing pin 20.

The striker retaining system 12 generally comprises a retainer having a retainer pin 38 and a coiled spring 40, a hole 42 in the frame, 14, a slot 44 in the striker sleeve 34, and the notch 32 of the firing pin 20. The spring 40 is a coiled spring located between the bottom of the hole 42 and the bottom portion of the retainer pin 38. The spring 40 biases the retainer pin 38 in an upward direction towards a striker retaining position. The striker retaining position of the retainer pin 38 is shown in FIG. 2 and 2A; when the slide 16 has been removed from the frame 14. However, in addition to the striker retaining position, the retainer pin 38 can be located at a non-retaining position, as shown in FIGS. 1 and 1A when the slide 16 is operationally connected to the frame 14. The retainer pin 38 is longitudinally movable in the hole 42 and slot 44 between the retaining position and the non-retaining position. The top end 46 of retainer pin 38 has a first upper ramp surface 48, a second lower ramp surface 50, and a latching surface 52. The latching surface 52 is located behind the first upper ramp surface 48. A portion of the top end 46 having the first ramp surface 48 and the latching surface 52 is adapted to move into and out of the striker sleeve channel 35. The slot 44 and top end 46 of the retainer pin 38 are suitably configured to allow the pin 38 to longitudinally move up and down, but prevents the retainer pin 38 from axially rotating.

The function of the striker retainer system 12 will now be described. Unlike the striker in U.S. Pat. No. 5,050,480, the striker 18 of the pistol 10 is not necessarily removed with the slide 16 when the slide 16 is removed from the frame 14. The striker 18 could be retained with the frame 14 when the slide 16 is removed from the frame 14; such as when the striker 18 is at a cocked position. As seen in FIGS. 1 and 1A, when the slide 16 is operationally connected to the frame 14, a surface 54 of the slide contacts the second lower ramp surface 50 of the retainer pin 38 to keep the retainer pin 38 at its non-retaining position. In this non-retaining position, the upper end 46 of the retaining pin 38 is not located in the striker sleeve channel 35. Thus, the retainer pin 38 does not interfere with the operation of the striker 18 while the slide 16 is attached to the frame 14. However, when the slide 16 is removed from the frame 14, as shown in FIGS. 2 and 2A, the surface 54 of the slide no longer keeps the retainer pin 38 down. Thus, the spring 40 moves the retainer pin to its retaining position with the top end 46 extending into the striker sleeve channel 35.

When the striker 18 is located at its cocked position with the slide 16 removed, as shown in FIGS. 2 and 2A, the top end 46 of the retainer pin 38 projects into notch 32 at the rear end of the firing pin 20. In the event the firing mechanism is actuated to allow the striker spring 22 to propel the firing pin 20 forward, the latching surface 33 contacts the latching surface 52. This stops the firing pin 20 from being propelled forward and, thus, prevents the firing pin 20 from being propelled as a projectile off of the frame 14. The first upper ramp surface 48 is provided such that, if the slide 16 is removed from the frame 14 when the striker 18 is not at its fully cocked position, but is subsequently moved to its fully cocked position, the surface 48 allows the rear end of the firing pin 20 to move the retaining pin 38 down and out of the firing pin's path until the notch 32 comes into registry with the retaining pin 38. At that point, the top end 46 of the retaining pin 38 can snap into the notch 32.

When the slide 16 is reattached to the frame 14, the rear end of the slide, proximate surface 54, is able to contact the second lower ramp 50 of the retaining pin 38 to push the retaining pin 38 back to its retracted non-retaining position shown in FIGS. 1 and 1A. Thus, the striker retaining system 12 is only operational when the slide 16 has been removed from the frame (or at least no longer restrains the retaining pin 38). In alternate embodiments, other types of retaining system springs could be used. Other types of retaining members, other than a retaining pin, could be used. Other types of shapes of the top end of the retaining pin could be used. The system could be used with other types of strikers and/or be adapted to engage the striker at a location other than at a rear end of the striker. Another surface of the slide could also be used to retain the retaining pin at its retracted non-retaining position.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A firearm having a frame, a slide, a striker, and a safety system, the safety system comprising:

a retainer member movably mounted to the frame for retaining the striker at a predetermined position on the frame when the slide is removed from the frame;

a spring biasing the retainer member towards a striker retaining position; and a surface on the slide for maintaining the retainer member at a non-retaining position while the slide is operationally connected to the frame, wherein the retainer member limits movement of the striker on the frame only when the slide is removed from the frame.

2. A firearm as in claim 1 wherein the retainer member is a pin that is longitudinally movably mounted in a hole of the frame generally perpendicular to movement of the striker on the frame.

3. A firearm as in claim 2 wherein the spring is a coil spring located at the bottom of the hole that is compressed by the retainer member.

4. A firearm as in claim 2 wherein the frame has a channel that the striker movably extends through, the retainer member extending into the channel when the slide is removed.

5. A firearm as in claim 1 wherein the retainer member has a first end with a first ramp surface, a second ramp surface, and a latching surface located behind the first ramp surface.

6. A firearm as in claim 5 wherein the second ramp surface is located outside the frame when the slide is removed from the frame such that, when the slide is operably connected to the frame, the slide contacts the second ramp surface to retain the retainer member at a retracted position.

7. A firearm as in claim 5 wherein the striker has a notch that the latching surface extends into when the slide is removed from the frame and the striker is located at a cocked position.

* * * * *